US009581376B2

(12) United States Patent
Kayano et al.

(10) Patent No.: US 9,581,376 B2
(45) Date of Patent: Feb. 28, 2017

(54) EJECTOR

(71) Applicant: DENSO CORPORATION, Kariya, Aichi-pref. (JP)

(72) Inventors: Kenta Kayano, Obu (JP); Etsuhisa Yamada, Kariya (JP); Haruyuki Nishijima, Obu (JP); Yoshiaki Takano, Kosai (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 14/779,674

(22) PCT Filed: Mar. 19, 2014

(86) PCT No.: PCT/JP2014/001590
§ 371 (c)(1),
(2) Date: Sep. 24, 2015

(87) PCT Pub. No.: WO2014/156075
PCT Pub. Date: Oct. 2, 2014

(65) Prior Publication Data

US 2016/0047586 A1 Feb. 18, 2016

(30) Foreign Application Priority Data

Mar. 27, 2013 (JP) ..... 2013-066211

(51) Int. Cl.
*F25D 17/02* (2006.01)
*F04F 5/10* (2006.01)
(Continued)

(52) U.S. Cl.
CPC ..... *F25D 17/02* (2013.01); *B05B 1/3489* (2013.01); *F04F 5/10* (2013.01); *F04F 5/46* (2013.01)

(58) Field of Classification Search
CPC ..... B05B 1/3405; B05B 1/341; B05B 1/3421; B05B 1/3426; B05B 1/3468;
(Continued)

(56) References Cited

U.S. PATENT DOCUMENTS 5,462,229 A * 10/1995 Tanaka ..... F04F 5/461 239/397.5
2009/0229304 A1 9/2009 Ogata et al.
(Continued)

FOREIGN PATENT DOCUMENTS

GB 1530128 A 10/1978
JP S51065407 A 6/1976
(Continued)

OTHER PUBLICATIONS

International Search Report and Written Opinion (in Japanese with English Translation) for PCT/JP2014/001590, mailed Apr. 22, 2014; ISA/JP.

*Primary Examiner* — Christopher Kim
(74) *Attorney, Agent, or Firm* — Harness, Dickey & Pierce, P.L.C.

(57) ABSTRACT

An interior of a nozzle in an ejector is formed with a swirling space in which a refrigerant swirls, and a refrigerant passage in which the refrigerant that has flowed from the swirling space is depressurized. The refrigerant passage includes a minimum passage area part most reduced in the refrigerant passage area, and a divergent part that gradually enlarges in the refrigerant passage area from the minimum passage area part toward a refrigerant ejection port. Plate members, which reduce a velocity component of the refrigerant flowing into the minimum passage area part in a swirling direction, are disposed within the refrigerant passage.

4 Claims, 10 Drawing Sheets

(51) Int. Cl.
*F04F 5/46* (2006.01)
*B05B 1/34* (2006.01)

(58) Field of Classification Search
CPC ..... B05B 1/3489; B05B 7/04; B05B 7/0408; B05B 7/10; F25D 17/02; F04F 5/02; F04F 5/10; F04F 5/44; F04F 5/46
USPC ..... 239/314, 318, 463, 468, 399, 403, 424, 239/424.5
See application file for complete search history.

(56) References Cited

U.S. PATENT DOCUMENTS

| | | | |
|---|---|---|---|
| 2011/0061423 | A1 | 3/2011 | Ogata et al. |
| 2011/0236227 | A1 | 9/2011 | Ogata et al. |
| 2012/0318894 | A1 | 12/2012 | Ogata et al. |
| 2014/0020424 | A1 | 1/2014 | Suzuki et al. |

FOREIGN PATENT DOCUMENTS

| | | | |
|---|---|---|---|
| JP | 2002130200 | A | 5/2002 |
| JP | 2009221883 | A | 10/2009 |
| JP | 2011058422 | A | 3/2011 |
| JP | 2011208523 | A | 10/2011 |
| JP | 2012202653 | A | 10/2012 |

* cited by examiner

EJECTOR

CROSS REFERENCE TO RELATED APPLICATIONS

This application is a U.S. National Phase Application under 35 U.S.C. 371 of International Application No. PCT/JP2014/001590 filed on Mar. 19, 2014 and published in Japanese as WO 2014/156075 A1 on Oct. 2, 2014. This application is based on and claims the benefit of priority from Japanese Patent Application No. 2013-066211 filed on Mar. 27, 2013. The entire disclosures of all of the above applications are incorporated herein by reference.

TECHNICAL FIELD

The present disclosure relates to an ejector that depressurizes a fluid, and draws the fluid by a suction action of an ejection fluid ejected at high speed.

BACKGROUND ART

Up to now, Patent Document 1 discloses a depressurizing device that is applied to a vapor compression refrigeration cycle device, and depressurizes the refrigerant.

The depressurizing device of Patent Document 1 has a main body portion that defines a swirling space for swirling refrigerant, and allows refrigerant in a gas-liquid mixing state, which is swirled in the swirling space, to flow into a minimum passage area part where a refrigerant passage area is most reduced, and to be reduced in pressure. In the gas-liquid mixing state, a gas-phase refrigerant and a liquid-phase refrigerant on a swirling center side are mixed together. With the above configuration, a state of the refrigerant flowing into the minimum passage area part is brought into the gas-liquid mixing state regardless of a change in the outside air temperature to suppress a variation in the refrigerant flow rate flowing out to a downstream side of the depressurizing device.

Further, Patent Document 1 also discloses an ejector using the depressurizing device as a nozzle. The ejector of this type draws a gas-phase refrigerant flowing out of an evaporator due to a suction action of an ejection refrigerant ejected from a nozzle, mixes the ejection refrigerant with the suction refrigerant in a pressure increase part (diffuser portion), thereby being capable of increasing the pressure.

Therefore, in the refrigeration cycle device (hereinafter referred to as "ejector refrigeration cycle") having the ejector as the refrigerant depressurizing means, a motive power consumption of the compressor can be reduced with the use of the refrigerant pressure increase action in a pressure increase part of the ejector, and a coefficient of performance (COP) of the cycle can be improved more than that of a normal refrigeration cycle device having an expansion valve as the refrigerant depressurizing means.

PRIOR ART DOCUMENT

Patent Document

Patent Document 1: JP 2012-202653 A

SUMMARY OF THE INVENTION

However, according to the present inventors' study, when the ejector disclosed in Patent Document 1 is applied to the ejector refrigeration cycle, although a variation in the refrigerant flow rate flowing out of the ejector can be suppressed, a refrigerant pressure increase amount in the pressure increase part of the ejector may be reduced more than a desired pressure increase amount.

Under the circumstances, as a result of investigation about the cause by the present inventors, it is found that in the ejector disclosed in Patent Document 1, the reduction in the refrigerant pressure increase amount is caused by a fact that the refrigerant flowing into a minimum passage area part of the nozzle is in a gas-liquid mixing state in which the gas-phase refrigerant is heterogeneously mixed with the liquid-phase refrigerant. In more detail, it is found that the reduction in the refrigerant pressure increase amount is caused by a fact that the refrigerant flowing into the minimum passage area part of the nozzle is in a state in which the gas-phase refrigerant is localized on the swirling center side and the liquid-phase refrigerant is localized on the outer peripheral side due to the action of a centrifugal force of a swirling flow.

The reason is because when the gas-phase refrigerant is localized on the swirling center side in the refrigerant flowing into the minimum passage area part of the nozzle, a boiling nuclear is hardly supplied to the liquid-phase refrigerant localized on the outer peripheral side, and a boiling delay occurs in the liquid-phase refrigerant localized on the outer peripheral side. The boiling delay causes a reduction in nozzle efficiency and a reduction in refrigerant pressure increase performance in the pressure increase part of the ejector. Meanwhile, the nozzle efficiency represents an energy conversion efficiency in converting a pressure energy of the refrigerant into a kinetic energy in the nozzle.

In view of the above, it is an objective of the present disclosure to suppress a reduction in nozzle efficiency of an ejector that depressurizes a fluid which is in a gas-liquid mixing state in a nozzle.

According of a first aspect of the present disclosure, an ejector includes a swirling space formation member, a nozzle and a body. The swirling space formation member defines a swirling space in which a fluid swirls. The nozzle includes a fluid passage in which the fluid flowing out of the swirling space is depressurized, and a fluid ejection port from which the fluid depressurized in the fluid passage is ejected. The body includes a fluid suction port through which a fluid is drawn due to an suction action of the fluid ejected at high speed from the fluid ejection port, and a pressure increase part that converts a velocity energy of a mixed fluid of the ejected fluid and the fluid drawn from the fluid suction port into a pressure energy. The fluid passage of the nozzle includes a minimum passage area part smallest in passage-cross-sectional area, and a divergent part that gradually enlarges in passage-cross-sectional area from the minimum passage area part toward the fluid ejection port. The ejector further includes a swirling suppression part which is disposed in the fluid passage of the nozzle and reduces a velocity component of the fluid in a swirling direction of the fluid flowing into the minimum passage area part from the swirling space.

According to the above configuration, the fluid swirls in the swirling space with the result that a fluid pressure of the swirling space on the swirling center side can be reduced to a pressure at which the fluid is depressurized and boiled (cavitation is generated). Then, the fluid on the swirling center side of the swirling space is allowed to flow into the nozzle whereby the fluid in the gas-liquid mixing state in which the gas-phase fluid and the liquid-phase fluid are mixed together can be depressurized in the nozzle.

Further, since a swirling suppression part is provided, a velocity component of the fluid flowing into the minimum passage area part in a swirling direction can be reduced. With the above configuration, the fluid flowing into the minimum passage area part can be restrained from becoming in a heterogeneous gas-liquid mixing state in which the gas-phase fluid is localized on the swirling center side, and the liquid-phase fluid is localized on the outer peripheral side due to an action of a centrifugal force of a swirling flow.

In other words, the state of the fluid flowing into the minimum passage area part can approximate the gas-liquid mixing state in which the gas-phase fluid and the liquid-phase fluid are homogeneously mixed together, and the boiling delay can be restrained from occurring in the fluid. Therefore, the fluid immediately after flowing into the minimum passage area part is blocked (choked), the flow velocity of the fluid is accelerated to a two-phase sonic velocity or higher, and the supersonic fluid can be further accelerated in a divergent part.

As a result, the flow rate of the fluid ejected from a fluid ejection port can be effectively accelerated, and a reduction in the nozzle efficiency of the ejector that depressurizes the fluid which is in the gas-liquid mixing state in the nozzle can be suppressed. A reduction in the fluid pressure increase performance in the pressure increase part of the ejector that depressurizes the fluid which is in the gas-liquid mixing state in the nozzle can be suppressed.

The gas-liquid mixing state in which the gas-phase fluid and the liquid-phase fluid are homogeneously mixed together can be defined as a state in which the liquid-phase fluid is formed into droplets (grains of the liquid-phase fluid) without being localized in a part (for example, an inner wall surface side of the passage) of the fluid passage of the nozzle, and homogeneously distributed in the gas-phase fluid. In the gas-liquid mixing state where the gas-phase fluid and the liquid-phase fluid are homogeneously mixed together, a flow rate of the droplets approximates a flow rate of the gas-phase refrigerant.

According to a second aspect of the present disclosure, an ejector includes a swirling space formation member, a nozzle and a body. The swirling space formation member defines a swirling space in which a fluid swirls. The nozzle includes a fluid passage in which the fluid flowing out of the swirling space is depressurized, and a fluid ejection port from which the fluid depressurized in the fluid passage is ejected. The body includes a fluid suction port through which a fluid is drawn due to an suction action of the fluid ejected at high speed from the fluid ejection port, and a pressure increase part that converts a velocity energy of a mixed fluid of the ejected fluid and the fluid drawn from the fluid suction port into a pressure energy. The fluid passage of the nozzle includes a minimum passage area part smallest in passage-cross-sectional area, a swirling suppression space that is disposed on a downstream side of the minimum passage area part and reduces a velocity component of the fluid in a swirling direction, and a divergent part that gradually enlarges in passage-cross-sectional area from a fluid outlet of the swirling suppression space toward the fluid ejection port.

According to the above configuration, as in the first aspect, the fluid in the gas-liquid mixing state in which the gas-phase fluid and the liquid-phase fluid are mixed together can be depressurized by the nozzle.

Further, since a swirling suppression space is defined in the fluid passage of the nozzle, a velocity component of the fluid in the swirling direction is reduced, and a state of the fluid can approximate the gas-liquid mixing state in which the gas-phase fluid and the liquid-phase fluid are homogeneously mixed together. Therefore, the fluid within the swirling suppression space is choked, the flow velocity of the fluid is accelerated to a two-phase sonic velocity or higher, and the supersonic fluid can be further accelerated in a divergent part.

As a result, as in the above first aspect, the flow rate of the fluid ejected from the fluid ejection port can be effectively accelerated, and a reduction in the nozzle efficiency of the ejector that depressurizes the fluid which is in the gas-liquid mixing state in the nozzle can be suppressed. A reduction in the fluid pressure increase performance in the pressure increase part of the ejector that depressurizes the fluid which is in the gas-liquid mixing state in the nozzle can be suppressed.

EMBODIMENTS FOR EXPLOITATION OF THE INVENTION

Figure 1:
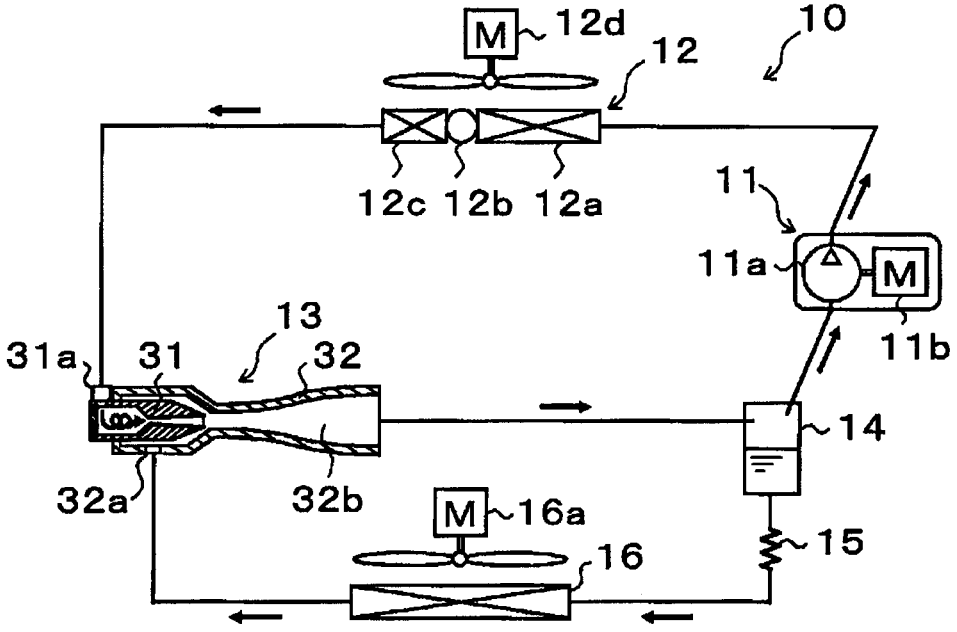
FIG. 1 is an overall configuration diagram of an ejector refrigeration cycle according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described with reference to FIGS. 1 to 4. As illustrated in an overall configuration diagram of FIG. 1, an ejector 13 according to this embodiment is applied to a vapor compression refrigeration cycle device having an ejector as a refrigerant depressurizing device, that is, an ejector refrigeration cycle 10. Therefore, the refrigerant may be used as an example of the fluid flowing in the ejector 13. Moreover, the ejector refrigeration cycle 10 is applied to a vehicle air conditioning apparatus, and performs a function of cooling blast air which is blown into a vehicle interior that is a space to be air-conditioned.

First, in the ejector refrigeration cycle 10, a compressor 11 draws a refrigerant, pressurizes the refrigerant to a high pressure refrigerant, and discharges the refrigerant. Specifically, the compressor 11 of this embodiment is an electric compressor in which a fixed-capacity compression mechanism 11*a* and an electric motor 11*b* for driving the compression mechanism 11*a* are accommodated in one housing.

Various compression mechanisms, such as a scroll-type compression mechanism and a vane-type compression mechanism, can be employed as the compression mechanism 11*a*. Further, the operation (rotating speed) of the electric motor 11*b* is controlled according to a control signal that is output from a control device to be described below, and any one of an AC motor and a DC motor may be employed as the electric motor 11*b*.

A refrigerant inlet side of a condenser 12*a* of a heat radiator 12 is connected to a discharge port of the compressor 11. The heat radiator 12 is a radiation heat exchanger that exchanges heat between a high-pressure refrigerant discharged from the compressor 11 and a vehicle exterior air (outside air) blown by a cooling fan 12*d* to radiate heat from the high-pressure refrigerant, and cool the high-pressure refrigerant.

More specifically, the heat radiator 12 is a so-called subcooling condenser including: the condenser 12*a* that condenses a high-pressure gas-phase refrigerant, which is discharged from the compressor 11, by exchanging heat between the high-pressure gas-phase refrigerant and the outside air, which is blown from the cooling fan 12*d*, to radiate the heat of the high-pressure gas-phase refrigerant; a receiver part 12*b* that separates gas and liquid of the refrigerant having flowed out of the condenser 12*a* and stores a surplus liquid-phase refrigerant; and a subcooling portion 12*c* that subcools a liquid-phase refrigerant having flowed out of the receiver part 12*b* by exchanging heat between the liquid-phase refrigerant and the outside air blown from the cooling fan 12*d*.

Meanwhile, the ejector refrigeration cycle 10 employs an HFC based refrigerant (specifically, R134a) as the refrigerant, and forms a subcritical refrigeration cycle in which a high pressure-side refrigerant pressure does not exceed a critical pressure of the refrigerant. The ejector refrigeration cycle 10 may employ an HFO based refrigerant (specifically, R1234yf) or the like as the refrigerant. Furthermore, refrigerator oil for lubricating the compressor 11 is mixed with the refrigerant, and a part of the refrigerator oil circulates in the cycle together with the refrigerant.

The cooling fan 12*d* is an electric blower of which the rotating speed (the amount of blast air) is controlled by a control voltage output from the control device.

A refrigerant inlet port 31*a* of the nozzle 31 of the ejector 13 is connected to a refrigerant outlet side of the subcooling portion 12*c* of the heat radiator 12. The ejector 13 functions as a depressurizing device for depressurizing the refrigerant which is a fluid flowing out of the heat radiator 12. The ejector 13 also functions as a refrigerant circulation device (refrigerant transport device) for drawing (transporting) the refrigerant by the suction action of an ejection refrigerant ejected from the nozzle 31 at high speed to circulate the refrigerant in the cycle.

Figure 2:
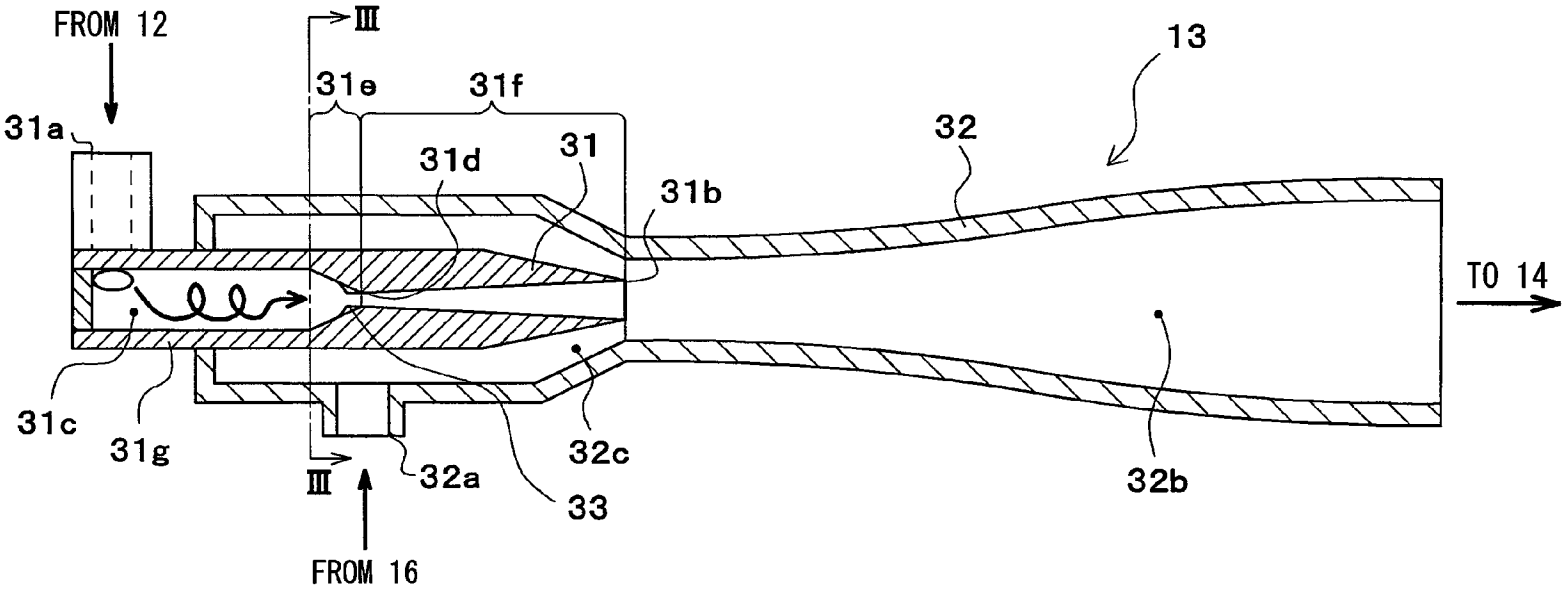
FIG. 2 is a sectional view of an ejector according to the first embodiment.
Figure 3:
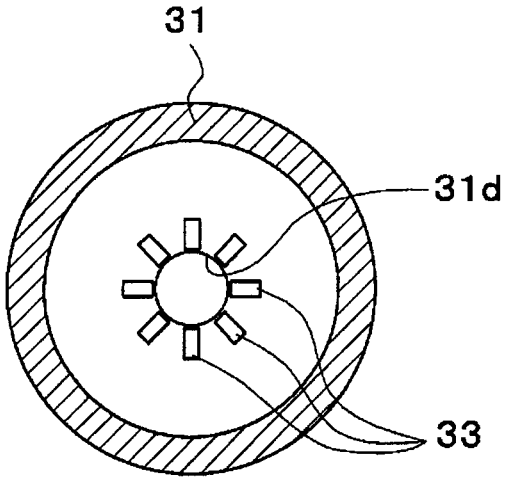
FIG. 3 is a cross-sectional view taken along a line III-III of FIG. 2.

A detailed configuration of the ejector 13 will be described with reference to FIGS. 2 and 3. The ejector 13 has the nozzle 31 and a body 32 as illustrated in FIG. 2. First, the nozzle 31 is made of metal (for example, stainless alloy) shaped into substantially a cylinder gradually tapered toward a flowing direction of the refrigerant, and the refrigerant flowing into the nozzle 31 is isentropically depressurized, and ejected from the refrigerant ejection port 31*b* defined on the most downstream side in the refrigerant flow.

The interior of the nozzle 31 is formed with a swirling space 31*c* in which the refrigerant that has flowed from the refrigerant inlet port 31*a* swirls, and a refrigerant passage in which the refrigerant flowing out of the swirling space 31*c* is depressurized. Further, the refrigerant passage is formed with a minimum passage area part 31*d* having a refrigerant passage area most reduced, a tapered part 31*e* having a refrigerant passage area gradually reduced toward the minimum passage area part 31*d* from the swirling space 31*c*, and a divergent part 31*f* gradually enlarged in the refrigerant passage area from the minimum passage area part 31*d* toward the refrigerant ejection port 31*b*.

The swirling space 31*c* is a cylindrical space that is provided on the most upstream side of the nozzle 31 in a refrigerant flow, and defined in the interior of a cylindrical part 31*g* extending coaxially in an axial direction of the nozzle 31. Further, a refrigerant inlet passage that connects the refrigerant inlet port 31*a* and the swirling space 31*c* extends in a tangential direction of an inner wall surface of the swirling space 31*c* when viewed from a center axis direction of the swirling space 31*c*.

With the above configuration, the refrigerant that has flowed into the swirling space 31*c* from the refrigerant inlet port 31*a* flows along an inner wall surface of the swirling space 31*c*, and swirls about a center axis of the swirling space 31*c*. Therefore, the cylindrical part 31*g* may be formed of a swirling space formation member forming the swirling space 31*c* in which the fluid swirls as an example, and in this embodiment, the swirling space formation member and the nozzle are formed integrally.

Since a centrifugal force acts on the refrigerant swirling in the swirling space 31*c*, a refrigerant pressure on the center axis side is lower than a refrigerant pressure on the outer peripheral side within the swirling space 31*c*. Accordingly, in this embodiment, during the normal operation of the ejector refrigeration cycle 10, the pressure of a refrigerant present on the center axis side in the swirling space 31*c* is lowered to a pressure at which a liquid-phase refrigerant is saturated or a pressure at which a refrigerant is depressurized and boiled (cavitation occurs).

The adjustment of the pressure of the refrigerant present on the center axis side in the swirling space 31*c* can be realized by adjusting the swirling flow rate of the refrigerant swirling in the swirling space 31*c*. Further, the swirling flow rate can be adjusted by, for example, adjusting an area ratio between the passage sectional area of the refrigerant inlet passage and the sectional area of the swirling space 31*c* perpendicular to the axial direction. Meanwhile, the swirling flow rate in this embodiment means the flow rate of the refrigerant in the swirling direction in the vicinity of the outermost peripheral part of the swirling space 31*c*.

The tapered part 31*e* is disposed coaxially with the swirling space 31*c* and formed into a truncated cone shape having a refrigerant passage area gradually reduced toward the minimum passage area part 31*d* from the swirling space 31*c*. For that reason, the refrigerant in the gas-liquid mixing state in which the gas-phase refrigerant and the liquid-phase refrigerant on the swirling center side of the refrigerant swirling in the swirling space 31*c* are mixed together flows into the minimum passage area part 31*d*.

The divergent part 31*f* is disposed coaxially with the swirling space 31*c* and the tapered part 31*e*, and formed into a truncated cone shape having a refrigerant passage area gradually enlarged toward the refrigerant ejection port 31*b* from the minimum passage area part 31*d*.

Plate members 33 as an example of the swirling suppression part that reduces a velocity component of the refrigerant, which flows into the minimum passage area part 31*d* from the swirling space 31*c* through the tapered part 31*e*, in the swirling direction are disposed on an inner peripheral wall surface of the refrigerant passage of the nozzle 31 according to this embodiment. As illustrated in FIGS. 2 and 3, the plate members 33 are extended in parallel to an axial direction (center axial direction of the swirling space 31*c*) of the nozzle 31 and a radial direction (radial direction of the swirling space 31*c*) of the nozzle 31.

The plate members 33 are disposed on the inner peripheral wall surface of the refrigerant passage defined in the interior of the nozzle 31, on the upstream side (that is, inside of the tapered part 31*e*) of the minimum passage area part 31*d*. Multiple (eight in this embodiment) plate members 33 are disposed at equal angular intervals around the nozzle 31 as illustrated in an enlarged cross-sectional view of FIG. 3.

The plate members 33 are intended to reduce the velocity component of the refrigerant in the swirling direction, but not intended to completely eliminate the velocity component of the refrigerant in the swirling direction. Under the circumstances, in this embodiment, as illustrated in an enlarged cross-sectional view of FIG. 3, when viewed from the axial direction, ends of the plate members 33 on the center axis side are located equally on the inner peripheral wall surface of the minimum passage area part 31*d*, or on the outer peripheral side with respect to the inner peripheral wall surface of the minimum passage area part 31*d*.

Then, the body 32 is made of metal (for example, aluminum) formed into substantially a cylindrical shape, functions as a fixing member for internally supporting and fixing the nozzle 31, and forms an outer shell of the ejector 13. More specifically, the nozzle 31 is fixed by press fitting so as to be housed in the interior of one end side in the longitudinal direction of the body 32.

A portion of an outer peripheral side surface of the body 32, which corresponds to an outer peripheral side of the nozzle 31, is provided with a refrigerant suction port 32*a* disposed to pass through that portion, and communicate with the refrigerant ejection port 31*b* of the nozzle 31. The refrigerant suction port 32*a* is a through-hole for drawing the refrigerant that has flowed out of an evaporator 16 into the interior of the ejector 13 due to the suction action of the ejection refrigerant ejected from the refrigerant ejection port 31*b* of the nozzle 31.

Therefore, an inlet space into which the refrigerant flows is defined around the refrigerant suction port 32*a* inside of the body 32, and a suction passage 32*c* is defined between an outer peripheral side around a tapered front end part of the nozzle 31 and an inner peripheral side of the body 32. The suction passage 32*c* leads the suction refrigerant flowing into the interior of the body 32 to a diffuser portion 32*b*.

A refrigerant passage area of the suction passage 32*c* is gradually reduced toward the refrigerant flow direction. With the above configuration, in the ejector 13 of this embodiment, a flow rate of the suction refrigerant flowing in the suction passage 32*c* is gradually accelerated, and an energy loss (mixing loss) in mixing the suction refrigerant with the ejection refrigerant is reduced by the diffuser portion 32*b*.

The diffuser portion 32*b* is disposed to be continuous to an outlet side of the suction passage 32*c*, and formed so that a refrigerant passage area gradually extends. This configuration performs a function of converting a velocity energy of a mixed refrigerant of the ejection refrigerant and the suction refrigerant into a pressure energy, that is, functions as a pressure increase part that decelerates a flow rate of the mixed refrigerant, and pressurizes the mixed refrigerant.

More specifically, a wall surface shape of the inner peripheral wall surface of the body 32 forming the diffuser portion 32*b* according to this embodiment is defined by the combination of multiple curves as illustrated in a cross-section along the axial direction in FIG. 2. A spread degree of the refrigerant passage cross-sectional area of the diffuser portion 32*b* gradually increases toward the refrigerant flow direction, and thereafter again decreases, as a result of which the refrigerant can be isentropically pressurized.

As illustrated in FIG. 1, a refrigerant outlet side of the diffuser portion 32*b* of the ejector 13 is connected with a refrigerant inlet port of an accumulator 14. The accumulator 14 is a gas-liquid separation device that separates gas and liquid of the refrigerant flowing into the interior of the accumulator 14 from each other. Further, the accumulator 14 of this embodiment functions as a reservoir for storing a surplus liquid-phase refrigerant in the cycle.

A liquid-phase refrigerant outlet port of the accumulator 14 is connected with a refrigerant inlet side of the evaporator 16 through a fixed aperture 15. The fixed aperture 15 is a depressurizing device for depressurizing the liquid-phase refrigerant flowing out of the accumulator 14. Specifically, the fixed aperture 15 can be formed of an orifice or a capillary tube.

The evaporator 16 is a heat exchanger for absorbing heat which exchanges heat between a low pressure refrigerant depressurized by the ejector 13 and the fixed aperture 15 and a blast air blown from the blower fan 16*a* into the vehicle interior to evaporate the low-pressure refrigerant and performs a heat absorbing effect.

The blower fan 16*a* is an electric blower of which a rotation speed (the amount of blast air) is controlled by a control voltage output from the control device. An outlet side of the evaporator 16 is connected with the refrigerant suction port 32*a* of the ejector 13. An intake side of the compressor 11 is connected to a gas-phase refrigerant outlet port of the accumulator 14.

Next, the control device (not shown) includes a well-known microcomputer including a CPU, a ROM and a RAM, and peripheral circuits of the microcomputer. The control device controls the operations of the above-mentioned various electric actuators 11*b*, 12*d*, and 16*a* and the like by performing various calculations and processing on the basis of a control program stored in the ROM.

An air conditioning control sensor group, such as an inside air temperature sensor for detecting a vehicle interior temperature, an outside air temperature sensor for detecting the temperature of outside air, a solar radiation sensor for detecting the amount of solar radiation in the vehicle interior, an evaporator-temperature sensor for detecting the blow-out air temperature from the evaporator 16 (the temperature of the evaporator), an outlet-side temperature sensor for detecting the temperature of a refrigerant on the outlet side of the heat radiator 12, and an outlet-side pressure sensor for detecting the pressure of the refrigerant on the outlet side of the heat radiator 12, is connected to the control device. Accordingly, detection values of the sensor group are input to the control device.

Furthermore, an operation panel (not shown), which is disposed near a dashboard panel positioned at the front part in the vehicle interior, is connected to the input side of the control device, and operation signals output from various operation switches mounted on the operation panel are input to the control device. An air conditioning operation switch that is used to perform air conditioning in the vehicle interior, a vehicle interior temperature setting switch that is used to set the temperature of the vehicle interior, and the like are provided as the various operation switches that are mounted on the operation panel.

Meanwhile, the control device of this embodiment is integrated with a control unit for controlling the operations of various control target devices connected to the output side of the control device, but the structure (hardware and software), which controls the operations of the respective control target devices, of the control device forms the control unit of the respective control target devices. For example, a structure (hardware and software), which controls the operation of the electric motor 11*b* of the compressor 11, forms a discharge capability control unit in this embodiment.

Next, the operation of this embodiment having the above-mentioned configuration will be described. First, when an operation switch of the operation panel is turned on, the control device operates the electric motor 11*b* of the compressor 11, the cooling fan 12*d*, the blower fan 16*a*, and the like. Accordingly, the compressor 11 draws and compresses a refrigerant and discharges the refrigerant.

The gas-phase refrigerant, which is discharged from the compressor 11 and has a high temperature and a high pressure, flows into the condensing part 12*a* of the heat radiator 12 and is condensed by exchanging heat between the air (outside air), which is blown from the cooling fan 12*d*, and itself and by radiating heat. The refrigerant, which has radiated heat in the condensing part 12*a*, is separated into gas and liquid in the receiver part 12*b*. A liquid-phase refrigerant, which has been subjected to gas-liquid separation in the receiver part 12*b*, is changed into a subcooled liquid-phase refrigerant by exchanging heat between the blast air, which is blown from the cooling fan 12*d*, and itself in the subcooling portion 12*c* and further radiating heat.

The subcooled liquid-phase refrigerant flowing out of the subcooling portion 12*c* of the radiator 12 is isentropically depressurized by the nozzle 31 of the ejector 13, and ejected. The refrigerant that has flowed from the evaporator 16 is drawn from the refrigerant suction port 32*a* due to the suction action of the ejection refrigerant which has been ejected from the refrigerant ejection port 31*b* of the nozzle 31. Further, the ejection refrigerant and the suction refrigerant drawn from the refrigerant suction port 32*a* flow into the diffuser portion 32*b*.

In the diffuser portion 32*b*, the velocity energy of the refrigerant is converted into the pressure energy due to the enlarged refrigerant passage area. As a result, the pressure of the mixed refrigerant of the ejection refrigerant and the suction refrigerant increases. The refrigerant that has flowed from the diffuser portion 32*b* flows into the accumulator 14, and is separated into gas and liquid.

The liquid-phase refrigerant separated by the accumulator 14 is isenthalpically depressurized by the fixed aperture 15. The refrigerant depressurized by the fixed aperture 15 flows into the evaporator 16, absorbs heat from the blast air blown by the blower fan 16*a*, and is evaporated. Accordingly, the blast air is cooled. On the other hand, a gas-phase refrigerant separated by the accumulator 14 is absorbed by the compressor 11, and again compressed.

The ejector refrigeration cycle 10 according to this embodiment operates as described above, and can cool the blast air to be blown into the vehicle interior. Further, in the ejector refrigeration cycle 10, since the refrigerant pressurized by the diffuser portion 32*b* is drawn into the compressor 11, the drive power of the compressor 11 can be reduced to improve the coefficient of performance (COP) of the cycle.

In the nozzle 31 of the ejector 13 according to this embodiment, the refrigerant swirls in the swirling space 31*c* with the results that a refrigerant pressure on a swirling center side within the swirling space 31*c* is reduced to a pressure at which the refrigerant is depressurized and boiled (cavitation occurs). Then, the refrigerant on the swirling center side of the swirling space 31*c* is allowed to flow into the nozzle 31 whereby the refrigerant in the gas-liquid mixing state in which the gas-phase refrigerant and the liquid-phase refrigerant are mixed together can be depressurized in the nozzle 31.

Further, since the ejector 13 of this embodiment has the plate member 33 as an example of the swirling suppression part, a velocity component of the refrigerant flowing into the minimum passage area part 31*d* in a swirling direction can be reduced. With the above configuration, the refrigerant flowing into the minimum passage area part 31*d* can be restrained from becoming in a heterogeneous gas-liquid mixing state in which the gas-phase refrigerant is localized on the swirling center side, and the liquid-phase refrigerant is localized on the outer peripheral side due to an action of a centrifugal force of a swirling flow.

In other words, the state of the refrigerant flowing into the minimum passage area part 31*d* can approximate the gas-liquid mixing state in which the gas-phase refrigerant and the liquid-phase refrigerant are homogeneously mixed together, and the boiling delay can be restrained from occurring in the refrigerant. Therefore, the refrigerant immediately after flowing into the minimum passage area part 31*d* is blocked (choked), the flow rate of the refrigerant is accelerated to a supersonic state (flow rate of a two-phase sonic velocity or higher), and the supersonic refrigerant can be further accelerated in the divergent part 31*f*.

As a result, the flow rate of the refrigerant ejected from the refrigerant ejection port 31*b* can be effectively accelerated, and a reduction in the nozzle efficiency of the ejector 13 can be suppressed. Then, with the acceleration of the flow rate of the refrigerant ejected from the refrigerant ejection port 31*b*, since the velocity energy converted into the pressure energy can be increased by the diffuser portion 32*b*, a reduction in the refrigerant pressure increase performance in the diffuser portion 32*b* of the ejector 13 can be suppressed. In other words, the COP improvement effect of the ejector refrigeration cycle 10 can be surely obtained.

The gas-liquid mixing state in which the gas-phase refrigerant and the liquid-phase refrigerant are homogeneously mixed together can be defined as a state in which the liquid-phase refrigerant is formed into droplets (grains of the liquid-phase refrigerant) without being localized in a part of the refrigerant passage of the nozzle 31, and homogeneously distributed in the gas-phase refrigerant. In the gas-liquid mixing state where the gas-phase refrigerant and the liquid-phase refrigerant are homogeneously mixed together, a flow rate of the droplets becomes equal to a flow rate of the gas-phase refrigerant.

Figure 4:
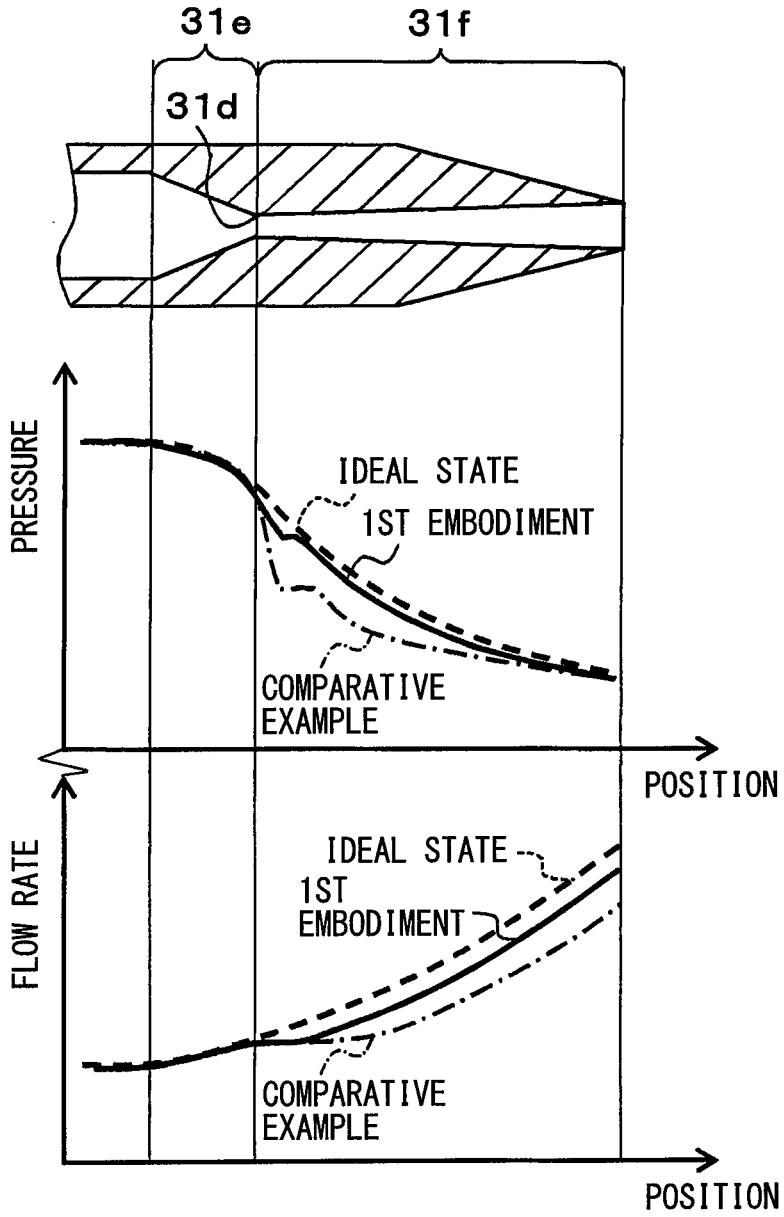
FIG. 4 is a diagram illustrating a pressure change and a flow rate change of a refrigerant flowing in a refrigerant passage within a nozzle according to the first embodiment.

The above fact will be described with reference to FIG. 4 in more detail. FIG. 4 is a graph illustrating a pressure change and a flow rate change of the refrigerant flowing in a refrigerant passage of the nozzle 31. In an upper side of FIG. 4, the nozzle 31 is schematically illustrated for the purpose of clarifying a correspondence relationship between the refrigerant passage of the nozzle 31 and the refrigerant flowing in the refrigerant passage.

First, the refrigerant that has flowed from the swirling space 31*c* flows into the tapered part 31*e* of the nozzle 31, and is accelerated in a subsonic state (flow rate lower than a two-phase sonic velocity) as it is while the pressure is reduced, with a reduction of the refrigerant passage area of the tapered part 31*e*.

Further, when it is assumed that the refrigerant is choked at the same time when the refrigerant flows into the minimum passage area part 31*d*, and the refrigerant becomes in a supersonic state (flow rate of a two-phase sonic velocity or higher) as indicated by a thick broken line in FIG. 4, the pressure of the refrigerant immediately after flowing into the minimum passage area part 31*d* drops with the enlargement of the refrigerant passage area in the divergent part 31*f*, but the flow rate of the refrigerant in the supersonic state can be further accelerated.

However, as shown in a comparative example of the present disclosure, when the refrigerant flowing into the minimum passage area part 31*d* becomes in a heterogeneous gas-liquid mixing state, the boiling of the refrigerant is delayed. Therefore, the refrigerant cannot be brought into the supersonic state at the same time when the refrigerant flows into the minimum passage area part 31*d*. For that reason, as indicated by an alternate long and short dash line in FIG. 4, the refrigerant cannot be accelerated even if the pressure of the refrigerant drops until the refrigerant flowing into the divergent part 31*f* is choked.

On the contrary, in this embodiment, since the plate members 33 as an example of the swirling suppression part is provided, the refrigerant flowing into the minimum passage area part 31*d* can approximate the homogeneous gas-liquid mixing state. After the refrigerant has flowed into the minimum passage area part 31*d*, the refrigerant is rapidly choked, and the refrigerant can be brought into the supersonic state.

Therefore, as indicated by a thick solid line in FIG. 4, the pressure of the refrigerant immediately after flowing into the minimum passage area part 31*d* drops with the enlargement of the refrigerant passage area in the divergent part 31*f*. However, after the refrigerant has flowed into the minimum passage area part 31*d*, the flow rate of the refrigerant that has become in the supersonic state can be rapidly accelerated. As a result, a reduction in the nozzle efficiency of the ejector 13 which depressurizes the fluid which is in the gas-liquid mixing state by the nozzle 31 can be suppressed.

Second Embodiment

Figure 5:
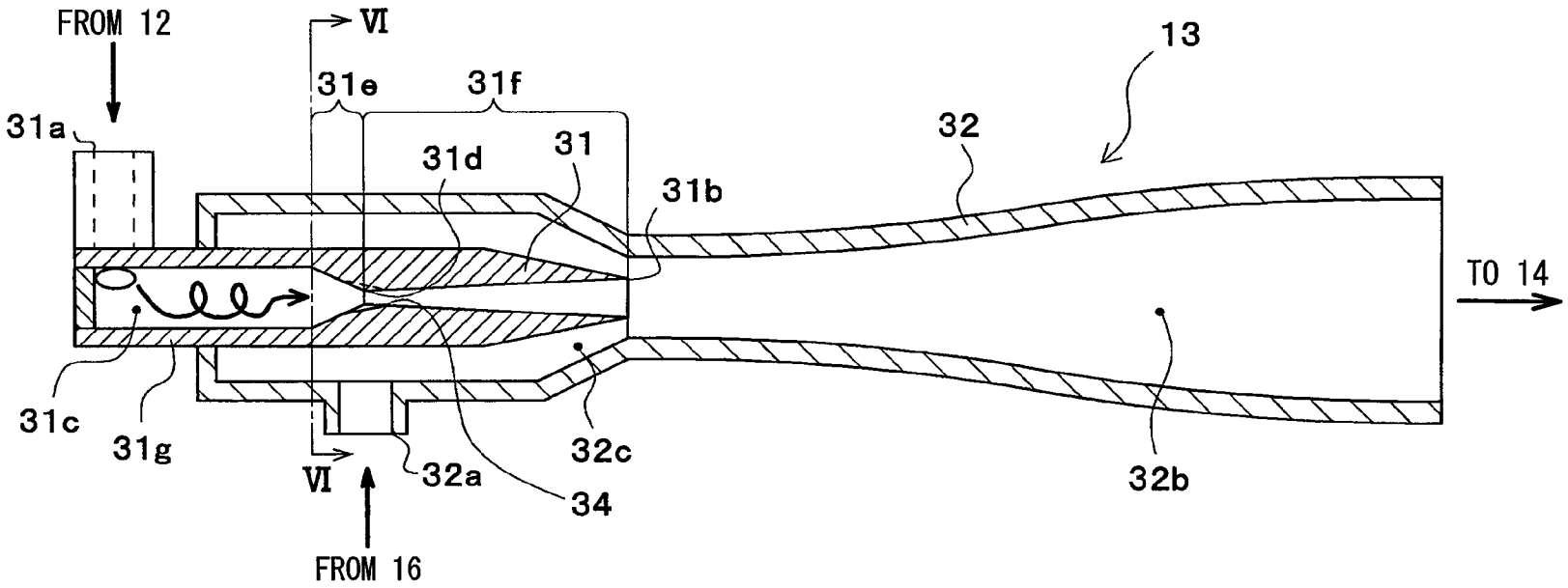
FIG. 5 is a sectional view of an ejector according to a second embodiment of the present disclosure.
Figure 6:
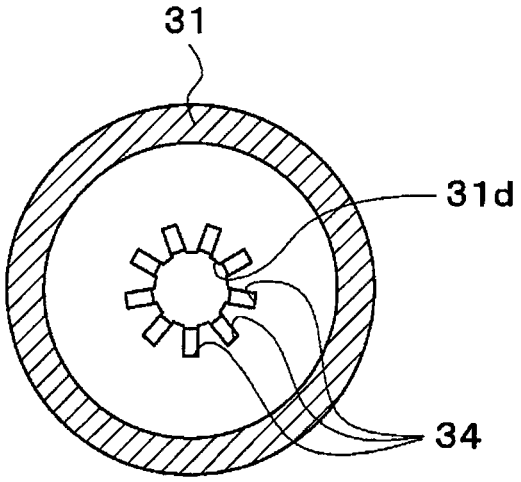
FIG. 6 is cross-sectional view taken along a line VI-VI in FIG. 5.

In the first embodiment, the example in which the swirling suppression part is formed of the plate members 33 is described. In this embodiment, as illustrated in FIGS. 5 and 6, an example in which the plate members 33 is replaced with groove portions 34 defined in an inner peripheral surface of the refrigerant passage provided in the interior of the nozzle 31. FIGS. 5 and 6 are drawings corresponding to FIGS. 2 and 3 in the first embodiment, respectively. In FIGS. 5 and 6, identical or equivalent parts to those in the first embodiment are denoted by the same symbols. The same is applied to the following drawings.

In more detail, the groove portions 34 used as an example of the swirling suppression part according to this embodiment is formed into a shape extending in the axial direction of the nozzle 31. Further, the groove portions 34 are formed in the inner peripheral wall surface of the refrigerant passage defined in the interior of the nozzle 31 to an area extending from an upstream side (that is, the interior of the tapered part 31*e*) of the minimum passage area part 31*d* to a downstream side (that is, the interior of the divergent part 31*f*) of the minimum passage area part 31*d*.

As illustrated in an enlarged cross-sectional view of FIG. 6, multiple groove portions 34 (nine in this embodiment) are dispose around the nozzle 31 at equal angular intervals. The other configurations and operation are identical with those in the first embodiment.

Therefore, even in the nozzle 31 of the ejector 13 according to this embodiment, a velocity component of the refrigerant flowing into the minimum passage area part 31*d* in a swirling direction can be reduced by the groove portions 34 which is an example of the swirling suppression part. As a result, as in the first embodiment, a reduction in the nozzle efficiency of the ejector 13 can be suppressed. Further, a reduction in the refrigerant pressure increase performance in the diffuser portion 32*b* of the ejector 13 which depressurizes the refrigerant that is in the gas-liquid mixing state in the nozzle 31 can be suppressed.

Third Embodiment

Figure 7A:
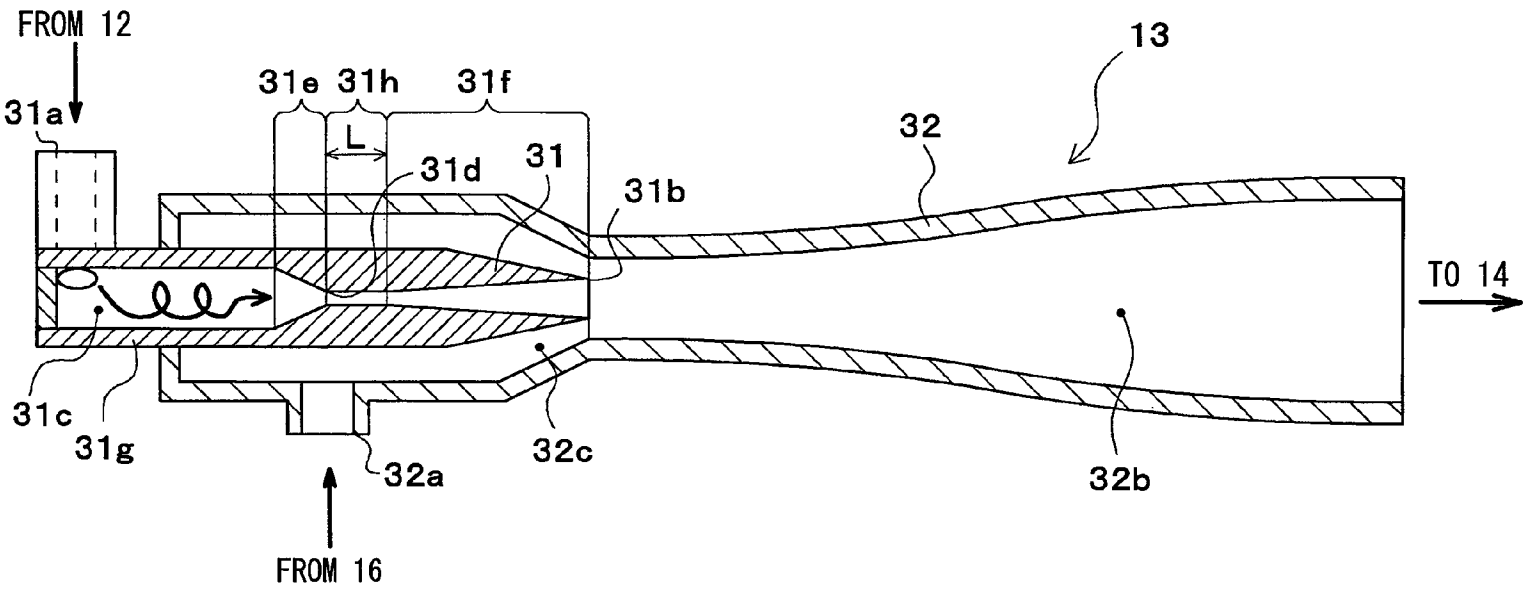
FIG. 7A is a cross-sectional view of an ejector according to a third embodiment of the present disclosure.
Figure 7B:
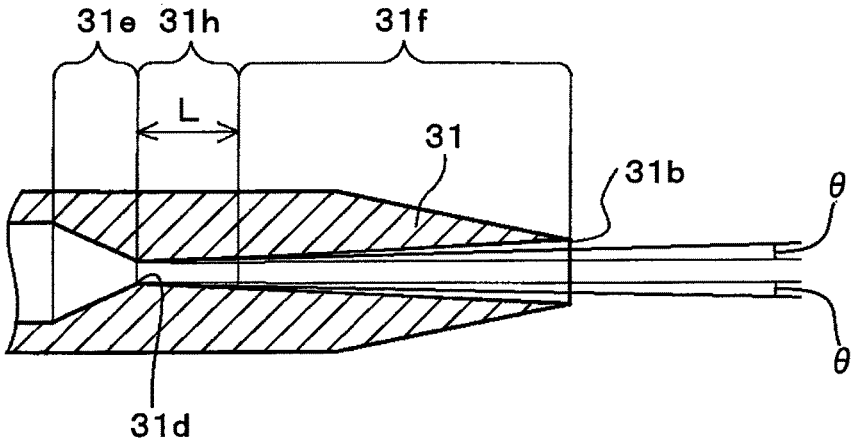
FIG. 7B is a sectional view illustrating a part of a nozzle of the ejector according to the third embodiment.

In this embodiment, as illustrated in FIGS. 7A and 7B, an example in which a swirling suppression space 31*h* is defined on the downstream side of the minimum passage area part 31*d* of the refrigerant passage provided in the interior of the nozzle 31 will be described. The swirling suppression space 31*h* is formed into a truncated cone shape disposed coaxially with the swirling space 31*c* and the tapered part 31*e*, and slightly enlarged in the refrigerant passage area from the minimum passage area part 31*d* toward the divergent part 31*f*.

Specifically, a spread angle θ in the cross-section of the swirling suppression space 31*h* in the axial direction is set to satisfy the following Mathematical Expression F1.

$$0<\theta\leq 1.5^\circ \tag{F1}$$

In other words, the swirling suppression space 31*h* according to this embodiment is formed into a truncated cone shape extremely close to a circular cylinder. Therefore, the spread angle θ in the cross-section of the swirling suppression space 31*h* in the axial direction is smaller than the spread angle in the cross-section of the divergent part 31*f* in the axial direction. In other words, the divergent part 31*f* is larger than the swirling suppression space 31*h* in an increase rate of the passage cross-sectional area in the refrigerant flow direction.

When an equivalent diameter of the minimum passage area part 31*d* is ϕ, a length L of the swirling suppression space 31*h* in the axial direction is set to satisfy the following Mathematical Expression F2.

$$0.25\times\phi\leq L\leq 10\times\phi \tag{F2}$$

The other configurations of the ejector 13 and the ejector refrigeration cycle 10 are identical with those in the first embodiment.

Therefore, when the ejector refrigeration cycle 10 according to this embodiment operates, the blast air blown into the vehicle interior can be cooled, and the COP of the cycle can be improved as in the first embodiment.

Further, since the swirling suppression space 31*h* is defined in the refrigerant passage of the nozzle 31, the velocity component of the refrigerant in the swirling direction is reduced within the swirling suppression space 31*h*, and a state of the refrigerant can approximate the gas-liquid mixing state in which the gas-phase refrigerant and the liquid-phase refrigerant are homogeneously mixed together. Therefore, the refrigerant within the swirling suppression space 31*h* is choked, the flow rate of the refrigerant is accelerated to a two-phase sonic velocity or higher, and the supersonic refrigerant can be further accelerated in the divergent part 31*f*.

As a result, the flow rate of the refrigerant ejected from the refrigerant ejection port 31*b* can be effectively accelerated, and a reduction in the nozzle efficiency of the ejector 13 can be suppressed. Further, a reduction in the refrigerant pressure increase performance in the diffuser portion 32*b* of the ejector 13 can be suppressed, and the COP improvement effect of the ejector refrigeration cycle 10 can be surely obtained.

Figure 8:
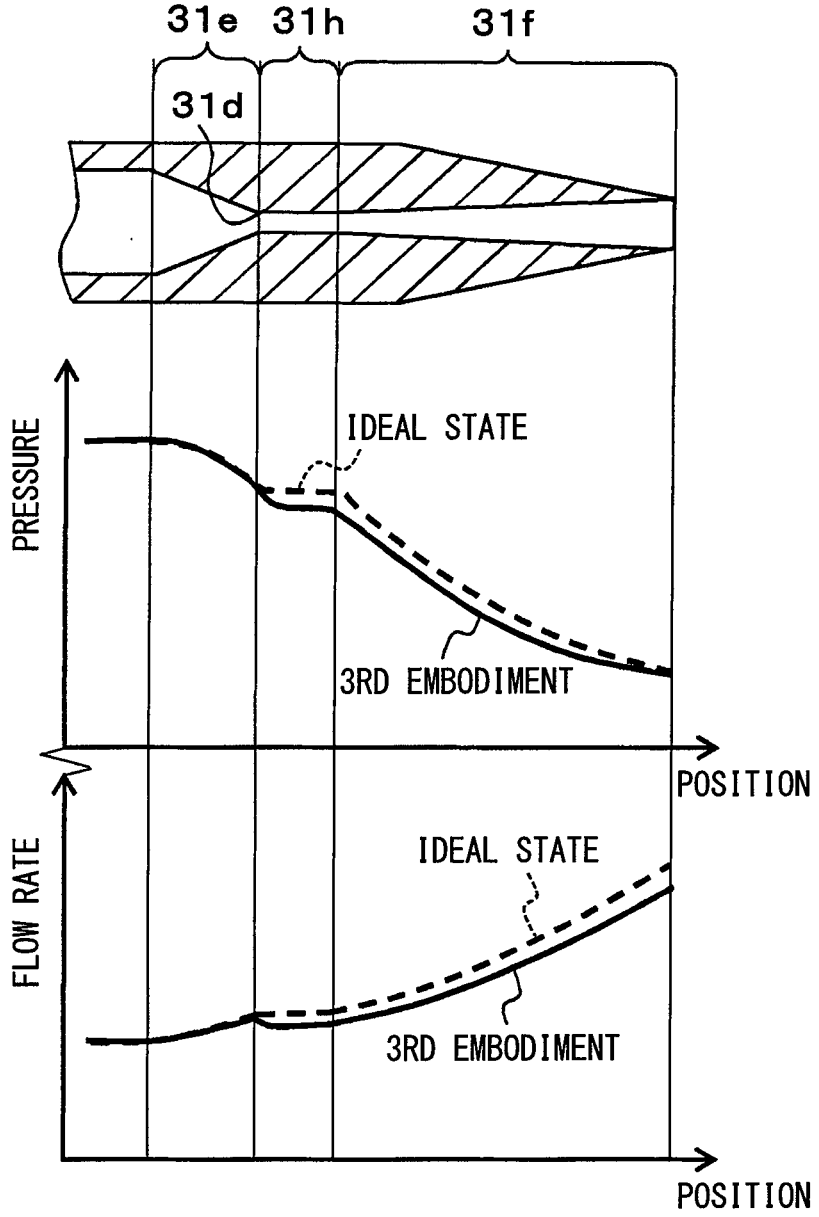
FIG. 8 is a diagram illustrating a pressure change and a flow rate change of a refrigerant flowing in a refrigerant passage within the nozzle according to the third embodiment.

The above fact will be described with reference to FIG. 8 in more detail. FIG. 8 is a drawing corresponding to FIG. 4 of the first embodiment. In the ejector 13 of this embodiment, since the swirling suppression part described in the first and second embodiments is not provided, the refrigerant flowing into the minimum passage area part 31*d* becomes in the heterogeneous gas-liquid mixing state in which the liquid-phase refrigerant is localized on the outer peripheral side. Therefore, in the nozzle 31 of this embodiment, the refrigerant immediately after flowing into the minimum passage area part 31*d* cannot be brought into the supersonic state.

On the contrary, since the swirling suppression space 31*h* is disposed on the downstream side of the minimum passage area part 31*d* in the refrigerant passage of the nozzle 31 according to this embodiment, the liquid-phase refrigerant localized on the outer peripheral side (inner peripheral wall surface side of the swirling suppression space 31*h*) frictions with the inner peripheral wall surface of the swirling suppression space 31*h*. As a result, the velocity component of the refrigerant in the swirling direction can be reduced.

With the above configuration, the state of the refrigerant flowing into the swirling suppression space 31*h* can approximate the gas-liquid mixing state in which the gas-phase refrigerant and the liquid-phase refrigerant are homogeneously mixed together, the refrigerant is choked within the swirling suppression space 31*h*, and the refrigerant can be brought into the supersonic state. Further, since the spread angle θ in the cross-section in the axial direction is defined to be extremely small in the swirling suppression space 31*h*, a reduction in the pressure associated with the enlargement in the refrigerant passage area hardly occurs in the swirling suppression space 31*h*.

Therefore, as indicated by a thick solid line in FIG. 8, the pressure of the refrigerant immediately after flowing into the minimum passage area part 31*d* drops with the enlargement of the refrigerant passage area in the divergent part 31*f*. However, the flow rate of the refrigerant that has become in the supersonic state within the swirling suppression space 31*h* can be accelerated. As a result, a reduction in the nozzle efficiency of the ejector 13 which depressurizes the fluid which is in the gas-liquid mixing state by the nozzle 31 can be suppressed.

According to the present inventors' study, as in this embodiment, the length L of the swirling suppression space 31*h* in the axial direction is set to satisfy the above Mathematical Expression F2. As a result, it is found that the velocity component in the swirling direction can be reduced until the heterogeneous gas-liquid mixing state surly becomes the homogeneous gas-liquid mixing state, and the refrigerant can be surely brought into the supersonic state within the swirling suppression space 31*h*.

In more detail, the length L of the swirling suppression space 31*h* in the axial direction, which is required to reduce the velocity component in the swirling direction until the heterogeneous gas-liquid mixing state becomes the homogeneous gas-liquid mixing state, has a correlation relationship with a density ratio ($\rho L/\rho g$) of a density $\rho L$ of the liquid-phase refrigerant and a density $\rho g$ of the gas-phase refrigerant used as an index of ease of refrigerant boiling.

Figure 9:
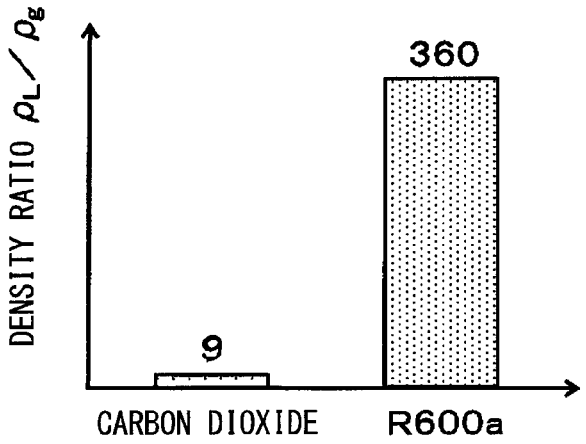
FIG. 9 is a diagram illustrating a density ratio ($\rho L/\rho g$) in a general refrigerant.

Under the circumstances, in this embodiment, as illustrated in FIG. 9, a range of the length L in the axial direction represented by the above Mathematical Expression F2 is determined on the basis of a minimum value (density ratio of carbon dioxide) and a maximum value (density ratio of R600a) of the density ratio of the refrigerant generally used.

The present disclosure is not limited to the above-mentioned embodiments, and may have various modifications as described below without departing from the gist of the present disclosure.

(1) In the above first embodiment, the plate members 33 as an example of the swirling suppression part are disposed upstream of the minimum passage area part 31*d*. However, the arrangement of the plate members 33 is not limited to the above example. For example, the plate members 33 may be arranged in a range from the upstream side of the minimum passage area part 31*d* to the downstream side of the minimum passage area part 31*d* if at least a part of the plate members 33 is disposed on the upstream side of the minimum passage area part 31*d*.

In the second embodiment, the example in which the groove portions 34 as an example of the swirling suppression part are defined in an area extending from the upstream side of the minimum passage area part 31*d* to the downstream side of the minimum passage area part 31*d*. Alternatively, the groove portions 34 may be formed only on the upstream side of the minimum passage area part 31*d*. Further, plate surfaces of the plate members 33 or the groove portions 34 may be disposed to be inclined or curved with respect to an axial line of the nozzle 31.

Figure 10:
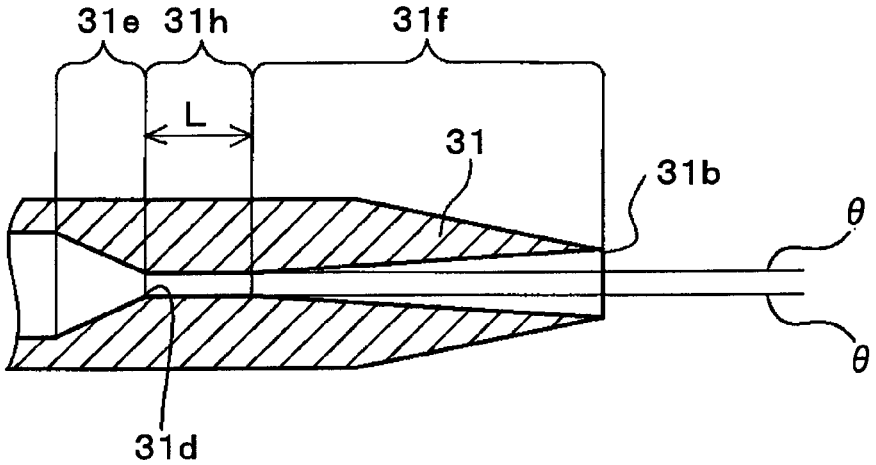
FIG. 10 is a cross-sectional view illustrating a part of a nozzle in an ejector according to a modification of the present disclosure.

(2) In the above second embodiment, the example in which the swirling suppression space 31*h* formed into the truncated cone shape is employed is described. Alternatively, as illustrated in FIG. 10, the swirling suppression space 31*h* may be formed into a cylindrical shape disposed coaxially with the swirling space 31*c* and the tapered part 31*e*. In other words, the swirling suppression space 31*h* may be formed so that the refrigerant passage area in the area extending from the minimum passage area part 31*d* to the divergent part 31*f* is kept constant. In other words, the spread angle θ in the cross-section of the swirling suppression space 31*h* in the axial direction may be 0°.

(3) In the above embodiments, the example in which the cylindrical part 31*g* forming the swirling space formation member is formed integrally with the nozzle 31 is described. Alternatively, the cylindrical part 31*g* may be configured separately from the nozzle 31.

Further, in the above embodiments, an outermost diameter of the swirling space 31*c* defined within the cylindrical part 31*g* is formed to be larger than a diameter of the minimum passage area part 31*d*. Therefore, the tapered part 31*e* that gradually reduces the refrigerant passage area is provided as the refrigerant passage for connecting the outlet of the swirling space 31*c* and the minimum passage area part 31*d*.

On the contrary, even if the outermost diameter of the swirling space 31*c* is equal to the diameter of the minimum passage area part 31*d*, if the refrigerant within the swirling space 31*c* can be sufficiently swirled, the tapered part 31*e* may be eliminated, and the outlet of the swirling space 31*c* may be formed as the minimum passage area part 31*d*. In that case, since the swirling space 31*c* is formed integrally with the swirling suppression space 31*h*, a reduction in the nozzle efficiency of the ejector 13 can be suppressed as in the third embodiment.

(4) In the above embodiments, the ejector refrigeration cycle 10 in which the accumulator 14 is connected to the outlet side of the ejector 13 is described. However, the application of the ejector according to the present disclosure is not limited to the above example.

For example, the ejector refrigeration cycle 10 may be applied to an ejector refrigeration cycle of a cycle configuration in which a branch part that branches a flow of the high pressure refrigerant flowing out of the heat radiator 12 is disposed on the upstream side of the nozzle 31 of the ejector 13, one refrigerant branched by the branch part is allowed to flow into the nozzle 31, and the other refrigerant branched by the branch part is allowed to flow into the evaporator 16 through the depressurizing device.

(5) In the above embodiments, an example in which the ejector refrigeration cycle 10 including the ejector 13 of the present disclosure is applied to a vehicle air conditioning apparatus has been described, but the application of the ejector of the present disclosure is not limited thereto. The ejector according to the present disclosure may be applied to an ejector refrigeration cycle for a stationary air conditioning apparatus or a cold storage warehouse, or may be applied to devices other than the ejector refrigeration cycle.

(6) In the ejector refrigeration cycle 10 according to the above embodiments, the example in which the heat radiator 12 is configured by an outdoor side heat exchanger that exchanges heat between the refrigerant and the outside air, and the evaporator 16 is used as the utilization side heat exchanger for cooling the indoor blast air is described. Alternatively, a heat pump cycle in which the evaporator 16 is used as an outdoor side heat exchanger that absorbs heat from a heat source such as outside air, and the heat radiator 12 is used as an indoor side heat exchanger that heats a fluid to be heated such as water may be configured.

What is claimed is:

1. An ejector comprising:

a swirling space formation member that defines a swirling space in which a fluid swirls;

a nozzle including a fluid passage in which the fluid flowing out of the swirling space is depressurized, and a fluid ejection port from which the fluid depressurized in the fluid passage is ejected; and a body including a fluid suction port through which a fluid is drawn due to a suction action of the fluid ejected at high speed from the fluid ejection port, and a pressure increase part that converts a velocity energy of a mixed fluid of the ejected fluid and the fluid drawn from the fluid suction port into a pressure energy, wherein the fluid passage of the nozzle includes a minimum passage area part smallest in passage-cross-sectional area, and a divergent part that gradually enlarges in passage-cross-sectional area from the minimum passage area part toward the fluid ejection port, the ejector further comprising a swirling suppression part which is disposed in the fluid passage of the nozzle and reduces a velocity component of the fluid in a swirling direction of the fluid flowing into the minimum passage area part from the swirling space, the swirling suppression part includes at least one groove portion provided on an inner peripheral surface of the fluid passage of the nozzle, and at least a part of the groove portion is disposed on an upstream side of the minimum passage area part.

2. The ejector according to claim 1, wherein the groove portion extends in the axial direction of the nozzle.

3. The ejector according to claim 1, wherein a plurality of the groove portions are arranged at predetermined intervals in the swirling direction.

4. The ejector according to claim 1, wherein the swirling space formation member is integrated with the nozzle.

* * * * *